US011261732B2

(12) United States Patent
Ju et al.

(10) Patent No.: US 11,261,732 B2
(45) Date of Patent: Mar. 1, 2022

(54) MINING MACHINE APPLICABLE TO FLUIDIZED MINING OF ORE BODIES AND MINING METHOD

(71) Applicant: CHINA UNIVERSITY OF MINING AND TECHNOLOGY, BEIJING, Beijing (CN)

(72) Inventors: Yang Ju, Beijing (CN); Heping Xie, Beijing (CN); Yan Zhu, Beijing (CN); Xiaodong Nie, Beijing (CN); Yong Zhang, Beijing (CN)

(73) Assignee: CHINA UNIVERSITY OF MINING AND TECHNOLOGY, BEIJING, Beijing (CN)

( * ) Notice: Subject to any disclaimer, the term of this patent is extended or adjusted under 35 U.S.C. 154(b) by 0 days.

(21) Appl. No.: 17/059,477

(22) PCT Filed: Jun. 5, 2019

(86) PCT No.: PCT/CN2019/090107

§ 371 (c)(1),
(2) Date: Nov. 30, 2020

(87) PCT Pub. No.: WO2020/243919

PCT Pub. Date: Dec. 10, 2020

(65) Prior Publication Data

US 2021/0317739 A1 Oct. 14, 2021

(51) Int. Cl.
*E21D 9/10* (2006.01)
*E21D 9/00* (2006.01)
(Continued)

(52) U.S. Cl.
CPC ..... *E21D 9/10* (2013.01); *E21D 9/001* (2013.01); *E21C 25/60* (2013.01); *E21C 25/66* (2013.01);
(Continued)

(58) Field of Classification Search
CPC ..... E21D 9/1073; E21D 9/116; E21D 9/001; E21D 9/002; E21D 9/10; E21D 9/087;
(Continued)

(56) References Cited

U.S. PATENT DOCUMENTS 3,924,895 A * 12/1975 Leasure ..... E21C 35/20 299/8
4,032,195 A * 6/1977 Kilroy ..... E21C 25/60 299/19
(Continued)

FOREIGN PATENT DOCUMENTS

CA 2295364 A1 7/2000
CA 3071590 A1 2/2019
(Continued)

OTHER PUBLICATIONS

International Search Report for PCT/CN2019/090107 dated Mar. 4, 2020, ISA/CN.
(Continued)

*Primary Examiner* — Janine M Kreck
*Assistant Examiner* — Michael A Goodwin
(74) *Attorney, Agent, or Firm* — Yue (Robert) Xu; Apex Attorneys at Law, LLP

(57) ABSTRACT

A mining machine applicable to fluidized mining and a mining method therefor are provided herein. A microwave transmitting mechanism, a liquid jet drill rod and a cutter-head are arranged at the head of a first excavation device of the mining machine. The ore body in front is first processed by the microwave transmitting mechanism and the liquid jet drill rod to reduce the strength of the ore body, which facilitates subsequent mining of the ore body, lowers the hardness requirements of the cutter-head, and reduces the wearing of the cutter-head. With this mining machine mining the ore body, the mined ores can be directly converted,
(Continued)

under the ground, into resources in the easily transportable form, without transporting the ore to the surface for conversion, which saves the cost of transporting the ore to the surface.

11 Claims, 5 Drawing Sheets

(51) Int. Cl.

| | |
|---|---|
| *E21C 37/16* | (2006.01) |
| *E21D 9/08* | (2006.01) |
| *E21D 9/11* | (2006.01) |
| *E21C 25/60* | (2006.01) |
| *E21C 25/66* | (2006.01) |
| *E21C 25/68* | (2006.01) |

(52) U.S. Cl.
CPC ..... *E21C 25/68* (2013.01); *E21C 37/16* (2013.01); *E21D 9/08* (2013.01); *E21D 9/1073* (2013.01); *E21D 9/116* (2013.01)

(58) Field of Classification Search
CPC ..... E21C 37/16; E21C 37/18; E21C 41/24; E21C 25/60; E21F 13/002; E21F 13/02; E21F 13/04; E21F 13/042; E21F 13/06; E21F 13/063; E21B 7/14; E21B 7/15; E21B 43/28; E21B 43/281; E21B 43/285; E21B 43/29; E21B 43/292
See application file for complete search history.

(56) References Cited

U.S. PATENT DOCUMENTS

| | | | | |
|---|---|---|---|---|
| 4,505,516 | A | 3/1985 | Shelton | |
| 5,813,482 | A * | 9/1998 | Barbera | E21B 7/046 175/171 |
| 2003/0038526 | A1 * | 2/2003 | Drake | E21D 9/12 299/18 |
| 2007/0085409 | A1 * | 4/2007 | Drake | E21C 41/24 299/8 |
| 2010/0148566 | A1 * | 6/2010 | Home | E21D 9/001 299/31 |
| 2014/0079485 | A1 * | 3/2014 | Li | E21D 9/003 405/141 |
| 2014/0219725 | A1 * | 8/2014 | Harrison | E21D 9/02 405/138 |
| 2014/0231398 | A1 * | 8/2014 | Land | B23K 26/0093 219/121.72 |
| 2018/0229245 | A1 | 8/2018 | Lin et al. | |
| 2019/0040741 | A1 * | 2/2019 | Feng | E21C 37/16 |
| 2019/0085688 | A1 * | 3/2019 | Helming | E21B 4/16 |
| 2020/0370434 | A1 | 11/2020 | Jordaan et al. | |

FOREIGN PATENT DOCUMENTS

| | | | | |
|---|---|---|---|---|
| CN | 105115335 | A * | 12/2015 | F28D 20/02 |
| CN | 105673067 | A | 6/2016 | |
| CN | 106765069 | A * | 5/2017 | |
| CN | 107542440 | A | 1/2018 | |
| CN | 107642346 | A | 1/2018 | |
| CN | 108825197 | A | 11/2018 | |
| CN | 108868722 | A | 11/2018 | |
| DE | 2234807 | A1 * | 1/1974 | E21D 9/1073 |
| GB | 1040495 | A | 8/1966 | |
| GB | 1490351 | A | 11/1977 | |

OTHER PUBLICATIONS

The Australian 1st Office Action for AU2019449030 dated Oct. 27, 2021.

* cited by examiner

MINING MACHINE APPLICABLE TO FLUIDIZED MINING OF ORE BODIES AND MINING METHOD

FIELD

The present application is a national phase application of PCT international patent application PCT/CN2019/090107, filed on Jun. 5, 2019, and relates to the technical field of mining of ore resources, and in particular to a mining machine applicable to fluidized mining of ore bodies and a mining method.

BACKGROUND

Solid mineral resources formed by geological processes on the earth surface or in the earth crust are solid natural enrichments having economic significance, which can be applied to industrial production, daily power generation and the like. The solid mineral resources may be energy minerals such as coal, oil shale, stone coal, natural asphalt, uranium, thorium and metallic ore.

With the continuous development of industrialization, the utilization of solid mineral resources has become the focus of people's concern, but the mining of solid mineral resources is difficult and high-risk. The conventional mining of solid mineral resources usually requires workers to perform mining operations under a mine. The underground air is thin while harmful gases are abundant, which is likely to cause personal injury accidents. Moreover, the mined solid mineral resources are transported to the ground, and then separated, extracted, converted, and utilized on the ground. The entire process is very complicated, and the process of transporting the solid mineral resources from the mine to the ground consumes a lot of labor and financial resources, resulting in high mining costs. In addition, the process of conversion and utilization of the solid mineral resources causes a lot of pollution such as solid waste pollution, air pollution.

SUMMARY

In view of this, a mining machine and a mining method suitable for fluidized mining are provided according to the embodiments of the present application, to solve the problems that, in the conventional technology, mining operation of workers under the mine easily cause personal injury accidents, and the cost of transportation of the entire mining process is high.

The following technical solution is provided according to the embodiments of the present application to achieve the above object.

In a first aspect, a mining machine suitable for fluidized mining is provided according to the present application, which includes: a first excavation device, a first separation device, a first fluidized conversion device and a first energy storage device.

The first excavation device is connected to the first separation device by a detachable flexible component, and a microwave transmitting mechanism, a liquid jet drill rod and a cutter-head are provided on the head of the first excavation device.

The microwave transmitting mechanism is configured to heat the ore body in front of the first excavation device to reduce the strength of the ore body. The liquid jet drill rod is configured to spray a softener into the ore body in front of the first excavation device to reduce the strength of the ore body. The cutter-head is configured to cut the ore body with reduced strength to obtain a solid mineral raw material, and the solid mineral raw material is transported to the first separation device.

The first separation device is connected to the first fluidized conversion device by a detachable flexible component, and is configured to separate ores and waste rocks in the solid mineral raw material and convey the ores after separation to the first fluidized conversion device.

The first fluidized conversion device is connected to the first energy storage device by a detachable flexible component, and is configured to convert the ores into resources in an easily transportable form and convey the resources in the easily transportable form to the first energy storage device for storage. The resources in the easily transportable form include at least one of fluidized resources, electrical energy, and thermal energy, and the fluidized resources include at least one of gas resources, liquid resources, and solid-liquid mixed resources.

In a possible implementation manner of the first aspect, the first separation device includes: a crusher, a second conveyor belt and a self-adjusting density separation mechanism.

The crusher is fixed on a bottom plate of the first separation device, and is configured to crush the solid mineral raw material obtained by cutting.

The second conveyor belt is fixed on the bottom plate of the first separation device, and is located behind the crusher, and is configured to convey the crushed solid mineral raw material to the self-adjusting density separation mechanism.

The self-adjusting density separation mechanism is fixed on the bottom plate of the first separation device, and is located behind the second conveyor belt, and is configured to separate the crushed solid mineral raw material to obtain ores and waste rocks and convey the ores to the first fluidized conversion device.

In another possible implementation manner of the first aspect, the first fluidized conversion device includes: a fluidizing mechanism and a purification mechanism.

The fluidizing mechanism is fixed on a bottom plate of the first fluidized conversion device, and is configured to convert the ores into resources in an easily transportable form and convey the resources in the easily transportable form to the first energy storage device.

The purification mechanism is fixed on the bottom plate of the first fluidized conversion device, and is located behind the fluidizing mechanism, and is configured to purify and convert the waste generated by the fluidizing mechanism.

In another possible implementation manner of the first aspect, the first excavation device includes: the microwave transmitting mechanism, multiple liquid jet drill rods, the cutter-head, a pushing mechanism and a first conveyor belt.

The microwave transmitting mechanism is arranged at the middle of the head of the first excavation device, and the multiple liquid jet drill rods are uniformly distributed around the head of the first excavation device. The cutter-head is arranged at the head of the first excavation device.

The pushing mechanism is fixed on a bottom plate of the first excavation device, and is located behind the cutter-head, and is configured to allocate the solid mineral raw material obtained by cutting to the first conveyor belt.

The first conveyor belt is arranged on the bottom plate behind the pushing mechanism, and extends into the first separation device, and is configured to convey the solid mineral raw material on the first conveyor belt to the first separation device.

In another possible implementation manner of the first aspect, the first excavation device includes: a first supporting seat and a supporting mechanism.

The first supporting seat is fixed on the bottom plate of the first excavation device and is configured to support the supporting mechanism.

The supporting mechanism is fixed on the first supporting seat, and is configured to reinforce an excavated roadway.

In another possible implementation manner of the first aspect, the first energy storage device includes: a first storage mechanism and a second storage mechanism.

The first storage mechanism is fixed on a bottom plate of the first energy storage device and is configured to store the fluidized resources.

The second storage mechanism is fixed on the bottom plate of the first energy storage device, and is configured to store the electrical energy and thermal energy.

In another possible implementation manner of the first aspect, the mining machine further includes: a supporting device. The supporting device includes: a second supporting seat, a grouting reinforcement mechanism and a roadway lining mechanism.

The second supporting seat is fixed on a bottom plate of the supporting device.

The grouting reinforcement mechanism is fixed on the second supporting seat, and is configured to reinforce mine walls on two sides of the roadway.

The roadway lining mechanism is fixed on the bottom plate of the supporting device, and is located behind the second supporting seat, and is configured to line and support the roadway.

In another possible implementation manner of the first aspect, the supporting device further includes: a third supporting seat and a gas extraction mechanism.

The third supporting seat is fixed on the bottom plate of the supporting device.

The gas extraction mechanism is fixed on the third supporting seat, and is configured to extract the gas resources in the mine walls on two sides of the roadway.

In another possible implementation manner of the first aspect, the mining machine further includes: a second excavation device, a second separation device, a second fluidized conversion device, and a second energy storage device.

The second excavation device is connected to the second separation device by a detachable flexible component, and is configured to cut the ore body in front of the second excavation device to obtain the solid mineral raw material, and the solid mineral raw material is transported to the second separation device.

The second separation device is connected to the second fluidized conversion device by a detachable flexible component, and is configured to separate ores and waste rocks in the solid mineral raw material and convey the ores after separation to the second fluidized conversion device.

The second fluidized conversion device is connected to the second energy storage device by a detachable flexible component, and is configured to convert the ores into resources in an easily transportable form and convey the resources in the easily transportable form to the second energy storage device for storage. The resources in the easily transportable form include at least one of fluidized resources, electrical energy, and thermal energy, and the fluidized resources include at least one of gas resources, liquid resources, and solid-liquid mixed resources.

The second energy storage device is connected to the first energy storage device by a detachable flexible component, and is configured to store the resources in the easily transportable form converted by the second fluidized conversion device.

In another possible implementation manner of the first aspect, the mining machine further includes a remote console.

The remote console is configured to control the working states of the first excavation device, the first separation device, the first fluidized conversion device, and the first energy storage device;

or, the remote console is further configured to control the working states of the second excavation device, the second separation device, the second fluidized conversion device, and the second energy storage device.

In a second aspect, a fluidized mining method is further provided according to the present application, which is applied to the mining machine suitable for fluidized mining. The method includes:

controlling the microwave transmitting mechanism in the first excavation device to heat the ore body in front of the first excavation device, and controlling the liquid jet drill rod in the first excavation device to spray a softener into the ore body in front of the first excavation device;

controlling the cutter-head in the first excavation device to cut the ore body with reduced strength to obtain the solid mineral raw material, and conveying the solid mineral raw material to the first separation device;

controlling the first separation device to separate the solid mineral raw material to obtain ores, and conveying the ores to the first fluidized conversion device; and controlling the first fluidized conversion device to convert the ores into resources in the easily transportable form, and conveying the resources in the easily transportable form to the first energy storage device for storage, wherein the resources in the easily transportable form include at least one of fluidized resources, electrical energy, and thermal energy, and the fluidized resources include at least one of gas resources, liquid resources, and solid-liquid mixed resources.

The mining machine suitable for fluidized mining provided by the present application includes the first excavation device, the first separation device, the first fluidized conversion device and the first energy storage device which are sequentially connected by the detachable flexible component. The microwave transmitting mechanism, the liquid jet drill rod and the cutter-head are arranged at the head of the first excavation device. The ore body in front is first processed by the microwave transmitting mechanism and the liquid jet drill rod to reduce the strength of the ore body, which facilitates subsequent mining of the ore body, lowers the hardness requirements of the cutter-head, and reduces the wearing of the cutter-head. Then, the ore body with reduced strength is cut by the cutter-head to obtain the solid mineral raw material, and the solid mineral raw material is conveyed to the first separation device. The ores and waste rocks in the solid mineral raw material are separated by the first separation device, and the ores are conveyed to the first fluidized conversion device. The ores are converted into resources in the easily transportable form by the first fluidized conversion device, and the resources in the easily transportable form are conveyed to the first energy storage device for storage. With this mining machine mining the ore body, the mined ore can be directly converted, under the ground, into resources in the easily transportable form, without transporting the ore to the surface for conversion, which saves the cost of transporting the ore to the surface, and reduces lots of pollution such as solid waste pollution and air pollution.

BRIEF DESCRIPTION OF THE DRAWINGS

For more clearly illustrating embodiments of the present application or the technical solutions in the conventional technology, drawings referred to for describing the embodiments or the conventional technology will be briefly described hereinafter. The drawings in the following description are only examples of the present application, and for those skilled in the art, other drawings may be obtained based on the provided drawings without any creative efforts.

DETAILED DESCRIPTION OF THE EMBODIMENTS

The technical solutions according to the embodiments of the present application will be described clearly and completely as follows in conjunction with the drawings in the embodiments of the present application. It is apparent that the described embodiments are only a part of the embodiments according to the present application, rather than all the embodiments. Based on the embodiments in the present application, all of other embodiments, made by those skilled in the art without any creative efforts, fall into the scope of the present application.

At present, the mining of solid mineral resources requires workers to go under the mine for mining operations, which is very likely to cause personal injury accidents. Moreover, the mined solid mineral resources need to be transported to the ground for separation, extraction, conversion, and utilization. The entire process is very complicated, and consumes a lot of labor and financial resources, resulting in high mining costs. In order to solve the technical problem, a mining machine and a mining method suitable for fluidized mining are provided by the present application. The mining machine converts the mined mineral raw materials into resources in an easily transportable form, and then transports the converted resources in the easily transportable form to the ground for direct utilization, which realizes underground unmanned and intelligent modes of mining, transportation and utilization.

Figure 1:
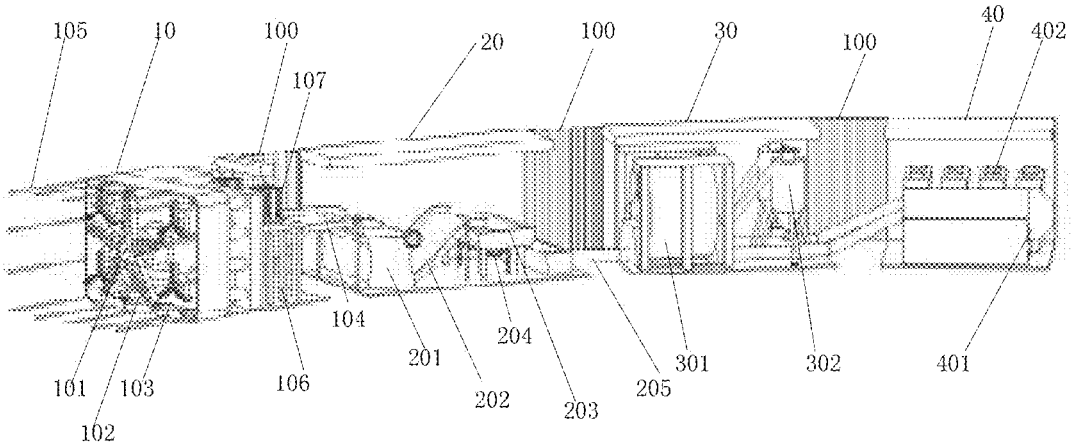
FIG. 1 is a structural view of a mining machine suitable for fluidized mining disclosed according to an embodiment of the present application.

Referring to FIG. 1, FIG. 1 is a structural view of a mining machine applicable to fluidized mining disclosed according to an embodiment of the present application.

As shown in FIG. 1, the mining machine includes: a first excavation device 10, a first separation device 20, a first fluidized conversion device 30 and a first energy storage device 40.

The first excavation device 10 is connected to the first separation device 20 by a detachable flexible component 100, and is configured to cut an ore body to obtain a solid mineral raw material, and the solid mineral raw material obtained by cutting is transported to the first separation device 20.

In order to reduce the strength of the ore body before cutting, a microwave transmitting mechanism 101, and a liquid jet drill rod 105 are provided at the head of the first excavation device 10.

The microwave transmitting mechanism 101 is provided at the head of the first excavation device 10, preferably at the middle of the head, for transmitting microwaves to heat the ore body in front of the first excavation device 10, broadening the original cracks inside the ore body and generating new cracks to reduce the strength of the ore body.

The liquid jet drill rod 105 is configured to drill into the ore body in front of the first excavation device 10 and spray a softener to soft the ore body, further reducing the strength of the ore body.

In order to increase the area of the ore body contacted by the liquid jet drill rod, multiple liquid jet drill rods 105 may be provided, and the multiple liquid jet drill rods 105 are uniformly arranged around the first excavation device 10.

In a possible implementation manner of the present application, the drill rod of the liquid jet drill rod 105 is a telescopic drill rod, multiple holes are provided on a side face of the drill rod body, and opening directions of the holes are all directed toward a central axis of the first excavation device 10.

The softener sprayed may be a carbonate solution, a bicarbonate solution, a cyanide solution, a chloride solution, a dilute sulfuric acid solution, a carbonic acid solution, and so on, and the present application is not limited thereto.

It should be noted that the sequence of the microwave transmitting mechanism 101 and the liquid jet drill rod 105 acting on the ore body is not limited by the present application. For example, the microwave transmitting mechanism 101 may first transmit microwaves to heat the ore body in front of the first excavation device 10, and then the liquid jet drill rod 105 drills into the ore body in front of the first excavation device 10 and sprays the softener to soft the ore body; or, the liquid jet drill rod 105 first drills into the ore body in front of the first excavation device 10 and softs the ore body, and then, the microwave transmitting mechanism 101 transmits microwaves to heat the ore body in front of the first excavation device 10.

After the strength of the ore body in front of the first excavation device 10 is reduced by the microwave transmitting mechanism 101 and the liquid jet drill rod 105, the ore body is cut by a cutter-head 102 provided at the head of the first excavation device 10 to obtain a solid mineral raw material.

It should be noted that the cutter-head 102 may be arranged at any position of the head of the first excavation device 10, which is not limited by the present application.

The ore body refers to the solid mineral raw materials stored in the surface or the crust, and the ore body is cut by the first excavation device 10 cuts to obtain small pieces of solid mineral raw materials.

The first separation device 20 is connected to the first fluidized conversion device 30 by a detachable flexible component 100, and is configured to separate ores and waste rocks in the solid mineral raw material and convey the ores after separation to the first fluidized conversion device 30.

The solid mineral raw materials include ores with economic value and useless rocks associated with the ores, namely waste rocks, where the waste rocks may be referred to as dunn bass or gangue.

The first fluidized conversion device 30 is connected to the first energy storage device 40 by a detachable flexible component 100, and is configured to convert the ores into resources in an easily transportable form and convey the resources in the easily transportable form to the first energy storage device 40 for storage.

The resources in the easily transportable form include at least one of fluidized resources, electrical energy, and thermal energy, and the fluidized resources include at least one of gas resources, liquid resources, and solid-liquid mixed resources.

Then, the fluidized resources such as liquid resources, gas resources, and mixed-state resources or electrical energy stored in the first energy storage device 40 may be transported to a designated location.

It should be noted that the detachable flexible component 100 is provided between each two adjacent devices included in the mining machine provided by the present application, which is conducive to the overall turning of the mining machine. The detachable flexible component 100 is strong enough to firmly connect the devices together, and is soft enough so that each device has a certain turning angle when the mining machine turns.

In addition, as shown in FIG. 1, the first excavation device 10 conveys the solid mineral raw material obtained by cutting to the first separation device 20 through an pushing mechanism 103 and a first conveyor belt 104.

The pushing mechanism 103 is fixed on a bottom plate of the first excavation device 10, and is located behind the cutter-head 102, and is configured to allocate the solid mineral raw material obtained by cutting to the first conveyor belt 104.

The first conveyor belt 104 is arranged on the bottom plate behind the pushing mechanism 103, and extends into the first separation device 20, and is configured to convey the solid mineral raw material on the first conveyor belt 104 to the first separation device 20.

In a possible implementation manner of the present application, the pushing mechanism 103 may be a star wheel. When the mining machine moves forward, the solid mineral raw material is allocated to the first conveyor belt 104 by the rotating star wheel. The number of star wheel is determined by a size of the star wheel and a width of the bottom plate of the first excavation device 10.

In other implementation manners of the present application, the pushing mechanism 103 may be a tool that can allocate solids such as an iron harrow or a rotating iron harrow.

Optionally, as shown in FIG. 1, the first excavation device 10 further includes a first supporting seat 106 and a supporting mechanism 107.

The first supporting seat 106 is fixed on the bottom plate of the first excavation device 10 and is configured to support the supporting mechanism 107.

A space is provided between the first supporting seat 106 and the bottom plate of the first excavation device 10, which allows the first conveyor belt 104 and objects on the first conveyor belt 104 to pass through.

In a possible implementation manner of the present application, the first supporting seat 106 is fixed to the bottom plate of the first excavation device 10 by welding which method is more secure.

The supporting mechanism 107 is fixed on the first supporting seat 106, and is configured to reinforce an excavated roadway.

In a possible implementation manner of the present application, the supporting mechanism 107 may be a bolt driller. The bolt driller is configured to support and protect the excavated roadway, which prevents the roof of the roadway from collapsing and the mine wall from collapsing.

The bolt driller can be fixed on the first supporting seat 106 by a bolt.

As shown in FIG. 1, in a possible implementation manner of the present application, the first separation device 20 includes a crusher 201, a second conveyor belt 202 and a self-adjusting density separation mechanism 203.

The crusher 201 is fixed on a bottom plate of the first separation device 20, and is configured to crush the solid mineral raw material obtained by cutting to obtain small particles of the solid mineral raw material.

The second conveyor belt 202 is fixed on the bottom plate of the first separation device 20, and is located behind the crusher 201, and is configured to convey the solid mineral raw material crushed by the crusher 201 to the self-adjusting density separation mechanism 203.

The self-adjusting density separation mechanism 203 is fixed on the bottom plate of the first separation device 20, and is located behind the second conveyor belt 202, and is configured to separate the crushed solid mineral raw material to obtain ores and waste rocks and convey the ores to the first fluidized conversion device 30.

In a possible implementation manner of the present application, the self-adjusting density separation mechanism 203 includes a suspension separation solution capable of adjusting density. Taking advantage of different densities of ores and waste rocks, the small particles of ores and waste rocks transported by the second conveyor belt 202 are separated.

Generally, ores and waste rocks have different densities. Therefore, the ores and waste rocks are placed in a suspension separation solution with a suitable density, so that either type of the ores and waste rocks is suspended on the surface of the suspension separation solution, while the other sinks into the bottom layer of the suspension separation solution, thus separating the ores from the waste rocks. The density of the suspension separation solution is determined according to the densities of the ores and waste rocks.

In addition, the waste rocks separated by the self-adjusting density separation mechanism 203 are discharged from the first separation device 20 through a discharge pipe 204.

The discharge pipe 204 may be arranged on a lateral side or a lower side of the self-adjusting density separation mechanism 203. In the embodiment shown in FIG. 1, the discharge pipe 204 is arranged on the lower side of the self-adjusting density separation mechanism 203.

The ores separated by the self-adjusting density separation mechanism 203 are conveyed to the first fluidized conversion device 30 through an output pipe 205 provided between the first separation device 20 and the first fluidized conversion device 30.

In a possible implementation manner, the output pipe 205 is arranged on a bottom plate of the second separation device 20 and located behind the self-adjusting density separation mechanism 203.

In a possible implementation manner of the present application, as shown in FIG. 1, the first fluidized conversion device 30 includes a fluidizing mechanism 301 and a purification mechanism 302.

The fluidizing mechanism 301 is fixed on a bottom plate of the first fluidized conversion device 30, and is configured to convert the ores into resources in an easily transportable form and convey the resources in the easily transportable form to the first energy storage device 40.

Specifically, the fluidizing mechanism 301 converts solid ore resources into fluidized resources such as liquid resources, gas resources, and mixed-state resources or electric energy by ore leaching, deflagration, liquefaction, gasification and other technologies, and may also radiate heat during the conversion process, that is, generate thermal energy.

In addition, waste may be generated during the conversion process, where the waste may include slag. The waste is purified and converted by the purification mechanism 302.

The purification mechanism 302 is fixed on the bottom plate of the first fluidized conversion device 30 and is located behind the fluidizing mechanism 301.

In a possible implementation manner of the present application, as shown in FIG. 1, the first energy storage device 40 includes a first storage mechanism 401 and a second storage mechanism 402.

The first storage mechanism 401 is fixed on a bottom plate of the first energy storage device 40 and is configured to store the fluidized resources such as gas resources, liquid resources, and mixed-state resources (such as a mixed state of solid and liquid).

The second storage mechanism 402 is fixed on the bottom plate of the first energy storage device 40, and is configured to store the electrical energy and thermal energy.

It should be noted that multiple first storage mechanisms 401 and second storage mechanisms 402 may be provided, which can be adjusted according to the energy storage situation, and is not limited by the present application.

In a possible implementation manner of the present application, the mining machine further includes a remote console.

The remote console is configured to control the working states of the first excavation device 10, the first separation device 20, the first fluidized conversion device 30, and the first energy storage device 40.

In order to enable the remote console to better control the working state of the mining machine, a state acquisition device is provided in each of the first excavation device 10, the first separation device 20, the first fluidized conversion device 30, and the first energy storage device 40. The state acquisition device uploads the state parameters collected by itself to the remote console, and the remote console controls the working state of each device in the mining machine according to the state parameters. The state parameters include driving parameters and operating parameters of each device. The state acquisition device may be an infrared acquisition sensor, an ultrasonic sensor, and other devices capable of state acquisition, which is not limited by the present application.

In the present application, a power driving device is further provided in each of the first excavation device 10, the first separation device 20, the first fluidized conversion device 30, and the first energy storage device 40, and the remote console drives each device to advance, reverse and turn according to the driving parameters of each device.

It should be noted that the remote console communicates with each device in the mining machine via wireless communication.

The wireless connection mode may be 4G, Bluetooth, or communication technologies such as LTE, which may be determined according to actual conditions and is not limited by the present application.

It should be further noted that the remote console may be a terminal or a host, which is not limited by the present application.

In summary, the remote console obtains the state parameters collected by the state acquisition device through the wireless network; and controls the operation of each device via the driving device according to the state parameters.

The mining machine applicable to fluidized mining provided by the present application includes the first excavation device, the first separation device, the first fluidized conversion device, and the first energy storage device which are sequentially connected by the detachable flexible component. The microwave transmitting mechanism, the liquid jet drill rod and the cutter-head are arranged at the head of the first excavation device. The ore body in front is first processed by the microwave transmitting mechanism and the liquid jet drill rod to reduce the strength of the ore body, which facilitates subsequent mining of the ore body, lowers the hardness requirements of the cutter-head, and reduces the wearing of the cutter-head. Then, the ore body with reduced strength is cut by the cutter-head to obtain the solid mineral raw material, and the solid mineral raw material is conveyed to the first separation device. The ores and waste rocks in the solid mineral raw material are separated by the first separation device, and the ores are conveyed to the first fluidized conversion device. The ores are converted into resources in the easily transportable form by the first fluidized conversion device, and the resources in the easily transportable form are conveyed to the first energy storage device for storage. With this mining machine mining the ore body, the mined ore can be directly converted, under the ground, into resources in the easily transportable form, without transporting the ore to the surface for conversion, which saves the cost of transporting the ore to the surface, and reduces lots of pollution such as solid waste pollution and air pollution.

The working process of the mining machine usually includes the stage of mine construction and roadway excavation and the stage of ore mining. The step of mine construction and roadway excavation is preparation for the next step of ore mining. The mining machine provided in the above embodiments is applicable to the stage of ore mining after the completion of the mine construction. In order to make the mining machine applicable to the stage of mine construction (that is, the stage of mine construction and roadway excavation), a supporting device is required.

Figure 2:
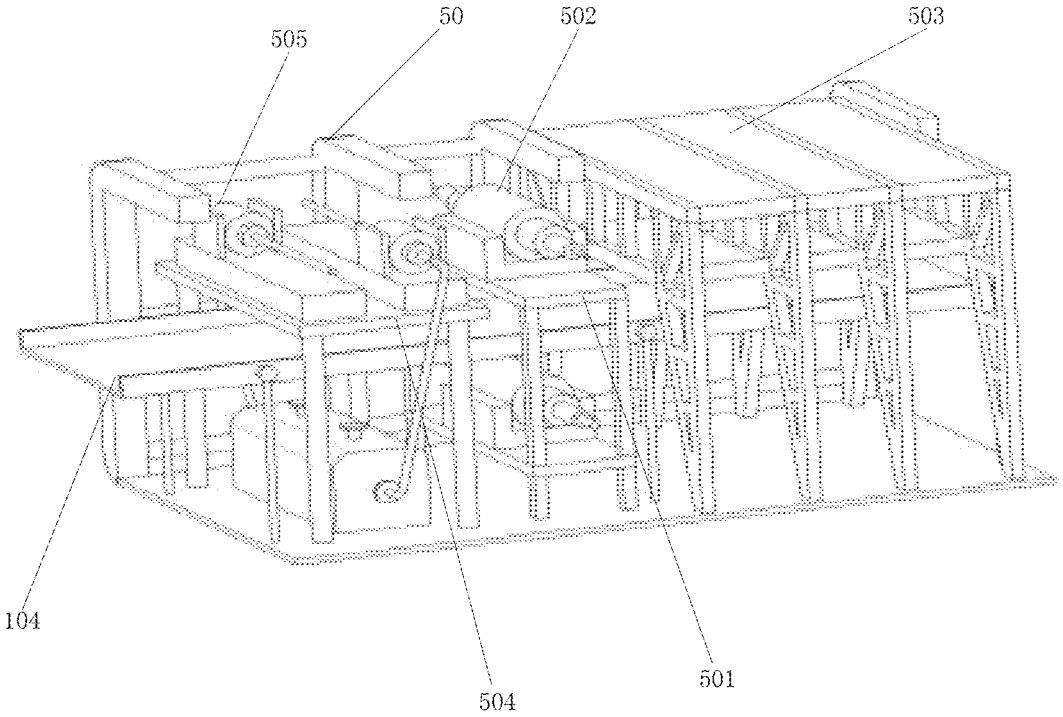
FIG. 2 is a schematic structural view of a supporting device disclosed according to an embodiment of the present application.

Referring to FIG. 2, FIG. 2 is a structural view of another mining machine applicable to fluidized mining provided by the present application. The mining machine in the present embodiment further includes a supporting device 50.

In the stage of mine construction and roadway excavation, the supporting device 50 is connected to the first excavation device 10 by a detachable flexible component 100, and is configured to support and protect the excavated roadway.

The first conveyor belt 104 in the first excavation device 10 extends into the supporting device 50, and is configured to convey the solid mineral raw materials to the tail of the supporting device 50 during the stage of mine construction and roadway excavation.

The supporting device 50 includes a second supporting seat 501, a grouting reinforcement mechanism 502 and a roadway lining mechanism 503.

The second supporting seat 501 is fixed on a bottom plate of the supporting device 50, and a space is provided between the second supporting seat 501 and the bottom plate, which allows the first conveyor belt 104 extending from the first excavation device 10 and objects on the first conveyor belt 104 to smoothly pass through.

The grouting reinforcement mechanism 502 is fixed on the second supporting seat 501, and is configured to reinforce mine walls on two sides of the roadway.

In a possible implementation manner of the present application, the grouting reinforcement mechanism 502 injects chemical slurry into the mine walls on two sides of the roadway to reinforce the mine walls on two sides of the roadway.

It should be noted that, the chemical slurry may be any slurry that can make the mine wall more solid such as fine cement, water glass, polyurethane solution, urea-formaldehyde resin solution, epoxy resin solution, Marithan solution, polyvinyl acetate latex, Luokexiu foam and other cementitious materials.

The roadway lining mechanism 503 is fixed on the bottom plate of the supporting device 50, and is located behind the second supporting seat 501, and is configured to line and support the excavated roadway to increase a service life of the roadway.

It should be noted that lining supporting and protecting refers to reinforcing the surrounding rocks of the underground cavity by using dressed stones, concrete or reinforced concrete in the underground cavity to form a wall with a certain thickness.

Optionally, based on the supporting device 50 disclosed above, a third supporting seat 504 and a gas extraction mechanism 505 may be further provided.

The third supporting seat 504 is fixed on the bottom plate of the supporting device 50, and may be located in front of the second supporting seat 501.

A space is provided between the third supporting seat 504 and the bottom plate of the supporting device 50, which allows the first conveyor belt 104 and objects on the first conveyor belt 104 to pass through.

The gas extraction mechanism 505 is fixed on the third supporting seat 504, and is configured to extract the gas resources in the mine walls on two sides of the roadway.

In a possible implementation manner of the present application, a variety of energy transmission pipelines are arranged in the excavated roadway to transfer the resources in the easily transportable form stored in the first energy storage device to a first designated location, and to transfer the extracted gas resources to a second designated location.

The first designated location and the second designated location are positions predetermined during the excavation of the roadway, and the first designated location and the second designated location may be different designated locations, or may be the same location, which is not limited by the present application.

The detailed process of the stage of mine construction and roadway excavation and the stage of ore mining is described below.

As an example, the specific process of the stage of mine construction and roadway excavation is as follows:

the first excavation device 10, the supporting device 50 and the detachable flexible components 100 are transported to underground for assembly, and the roadway is excavated after the assembly is completed;

the microwave transmitting mechanism 101 of the first excavation device 10 transmits microwaves to heat the ore body in front of the first excavation device 10, broadens the original cracks inside the ore body and generates new cracks to reduce the strength of the ore body; then, the liquid jet drill rod 105 drills into the ore body in front of the first excavation device 10 and sprays the softener from the holes of the drill rod itself, the softener infiltrates into the ore body through the cracks and seams in the ore body, softens the ore body, and further reduces the strength of the ore body; then, the cutter-head 102 cuts the ore body to obtain the solid mineral raw material, the cut solid mineral raw material is allocated to the first conveyor belt 104 by the pushing mechanism 103 and conveyed to the tail of the supporting device 50 for discharge; finally, the cut solid mineral raw material is transported away from the roadway by an underground shuttle.

In the case of excavating the roadway, the supporting mechanism 107 in the first excavation device 10 supports and protects the surroundings of the excavated roadway; and the gas extraction mechanism 505 in the supporting device 50 extracts the gas resources in the mine walls on two sides of the roadway; the grouting reinforcement mechanism 502 injects chemical slurry into the mine walls on two sides of the roadway to reinforce the mine walls on two sides of the roadway; and the roadway lining mechanism 503 provides lining support for the excavated roadway to increase a service life of the roadway.

As an example, the specific process of the stage of ore mining is as follows:

after the stage of mine construction and roadway excavation is completed, the first excavation device 10 and the supporting device 50 are separated, and the supporting device 50 is lifted to the ground. In the stage of ore mining, the devices in the mining machine and the detachable flexible components 100 connecting the devices are transported to the underground for assembly and connection.

Figure 3:
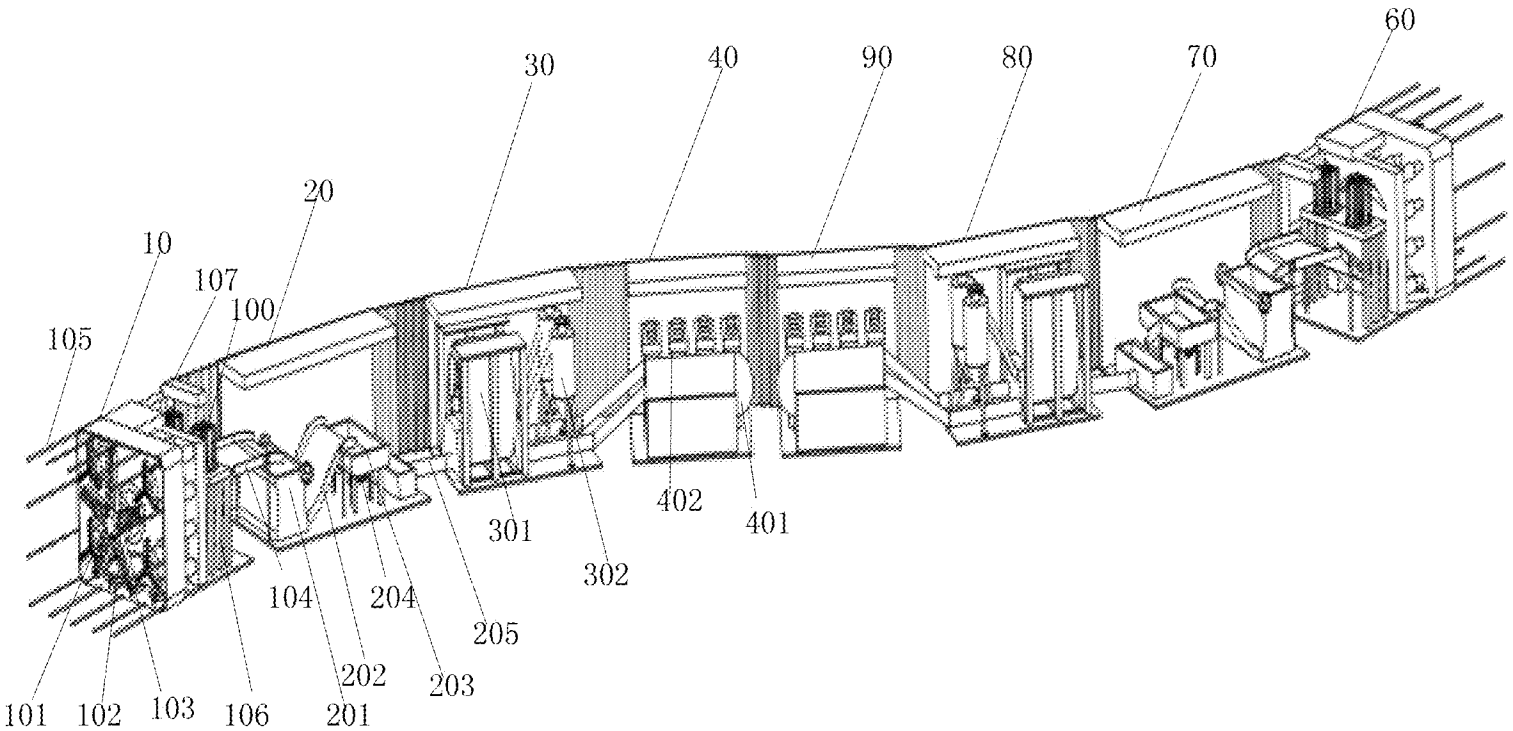
FIG. 3 is a structural view of another mining machine suitable for fluidized mining disclosed according to an embodiment of the present application.

In an embodiment of the present application, a strip-like route is adopted for bidirectional mining during the ore mining. A main structure of the mining machine includes front and back parts, and the front and back parts are of mirror distribution. As shown in FIG. 3, the first half of the mining machine in this embodiment includes from left to right in sequence a first excavation device 10, a first separation device 20, a first fluidized conversion device 30, and a first energy storage device 40; the second half of the mining machine includes from right to left in sequence a second excavation device 60, a second separation device 70, a second fluidized conversion device 80, and a second energy storage device 90.

The structures and functions of the first excavation device 10 and the second excavation device 60, the first separation device 20 and the second separation device 70, the first fluidized conversion device 30 and the second fluidized conversion device 80, and, the first energy storage device 40 and the second energy storage device 90, are identical respectively. In order to distinguish the two parts, the first and the second are used for distinguishing them. In addition, detachable flexible components 100 are used for connecting the functional devices.

The function of the excavation device during the stage of ore mining is basically same as that during the stage of mine construction and roadway excavation. The difference lies in that, in the case of excavating the roadway, the supporting mechanism 107 in the excavation device supports and protects the surroundings of the roadway; while in the case of ore mining, the supporting mechanism 107 in the excavation device supports and protects only the roof of the roadway.

In a possible implementation manner of the present application, the remote console is further configured to control the working states of the second excavation device 60, the second separation device 70, the second fluidized conversion device 80, and the second energy storage device 90.

It should be noted that, the way that the remote console controls the working states of the second excavation device 60, the second separation device 70, the second fluidized conversion device 80, and the second energy storage device 90 is the same as the way that the remote console controls the working states of the first excavation device 10, the first separation device 20, the first fluidized conversion device 30, and the first energy storage device 40, and will not be repeated herein again.

Based on the mining machine shown in FIG. 3 above, in an application scenario of the present application, in the stage of ore mining, the mining machine adopts a strip-like bidirectional mining method, that is, a combination of a forward mining method and a backward mining method. In this embodiment, the forward and backward movements are defined with reference to the moving direction of the first excavation device 10. When the first excavation device 10 moves toward its head, the mining machine is adopting the forward mining method, and when the first excavation device 10 moves toward its tail, the mining machine is adopting the backward mining method.

In a possible implementation manner of the present application, the first half of the mining machine works according to the forward mining method, that is, the first excavation device 10 mines the front ore body, and conveys the ores to the first separation device 20 for separation, the ores after separation are transported to the first fluidized conversion device 30, and are converted into resources in the easily transportable form, and are transported to the first storage device 40 for storage. After arriving the mine field boundary, the mining machine stops and then turns to the backward mining method. The second half of the mining machine works according to the backward mining method, that is, the second excavation device 60 mines the front ore body, and conveys the ores to the second separation device 70 for separation, the ores after separation are transported to the second fluidized conversion device 80, and are converted into resources in the easily transportable form, and are transported to the second storage device 90 for storage. After arriving the mine field boundary on the other side, the mining machine stops and then turns to the forward mining method. The forward mining method and the backward mining method are alternately performed to complete the mining of the entire mine field.

Apparently, in other embodiments, the forward and backward movements may be defined with reference to the moving direction of the second excavation device. The mining process is the same regardless of the moving direction of the excavation device, and is not repeated herein again.

Figure 4:
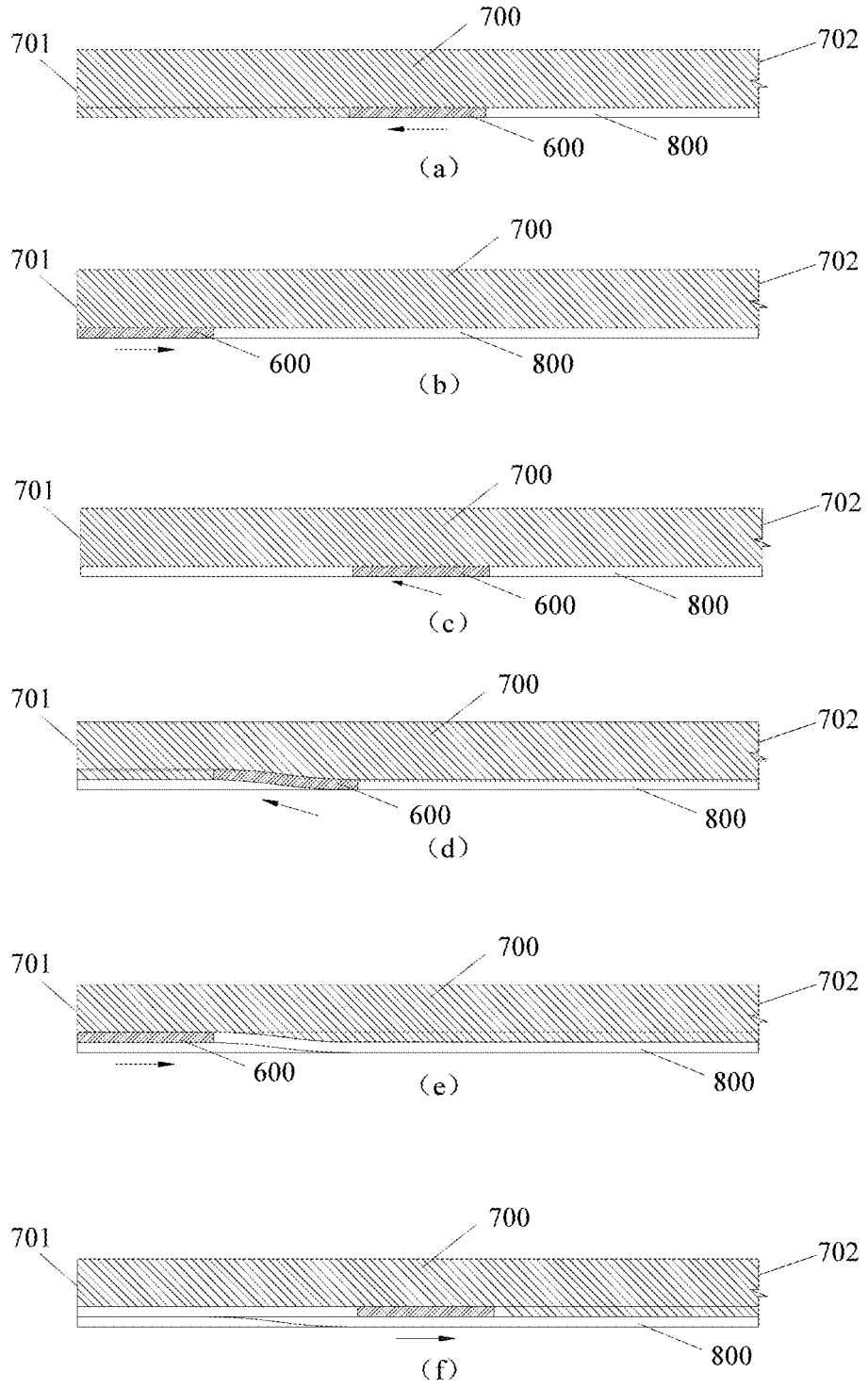
FIG. 4 is a top view of division steps of a mining method of "obliquely excavate into the mine and change the lane by righting the direction" applied by the mining machine disclosed according to an embodiment of the present application.

Since an overall length of the mining machine is long and the turning radius is large, a lane change method of "obliquely excavate into the mine and right the direction" is designed for the switch between the forward mining and the backward mining. The specific process thereof is as follows:

As shown in FIG. 4, in the state shown in (a) in the figure, the mining machine 600 mines the solid mineral resources in the ore field 700 in a straight line direction (that is, the direction indicated by the arrow). As the state shown in (b) in the figure, when mining to the first boundary 701 of the ore field 700, the mining machine will return by a first distance along the original path to the position shown in (c). Then, the mining machine enters the state shown in (d) in the figure, the mining machine 600 obliquely enters the ore body and changes the lane, and continues to mine in the forward mining method, and when the mining machine mines to the first boundary 701, the angle is just righted, and the lane change is completed, reaching the effect shown in (e). As the state shown in (f) in the figure, after the lane change is completed, the mining machine 600 mines the ore body along the straight line with the backward mining method. Until the mining machine reaches the other boundary of the mine field, namely the second boundary 702, the mining machine performs lane change according to the lane change method of "obliquely excavate into the mine and right the direction" and turns to the forward mining method.

The first distance is at least greater than the length of the entire mining machine itself. The second boundary 702 is the side of the mine field opposite to the first boundary.

As shown in FIG. 4, the area after mining is referred to as goaf 800. In order to prevent an overburden stratum above the goaf 800 from caving and effecting the mining operation of the mining machine, bolts are punched into the roof of the roadway by the supporting mechanisms provided in the first excavation device 10 and the second excavation device 60 during the mining process, and the strip-like goaf 800 is filled in time.

In a possible implementation manner of the present application, the filling slurry is transported from the ground to the underground through filling drill holes drilled from the ground to the underground, and then the slurry is transported to the goaf 800 through filling pipelines provided in the roadway, and is mixed with the waste rock sifted out by the self-adjusting density separation mechanism 203, to complete the filling of the goaf 800.

Optionally, in the present application, a variety of energy transmission pipelines are provided in the roadway to transfer the resources in the easily transportable form stored in the first energy storage device 40 and the second energy storage device 90 to a designated location.

Figure 5:
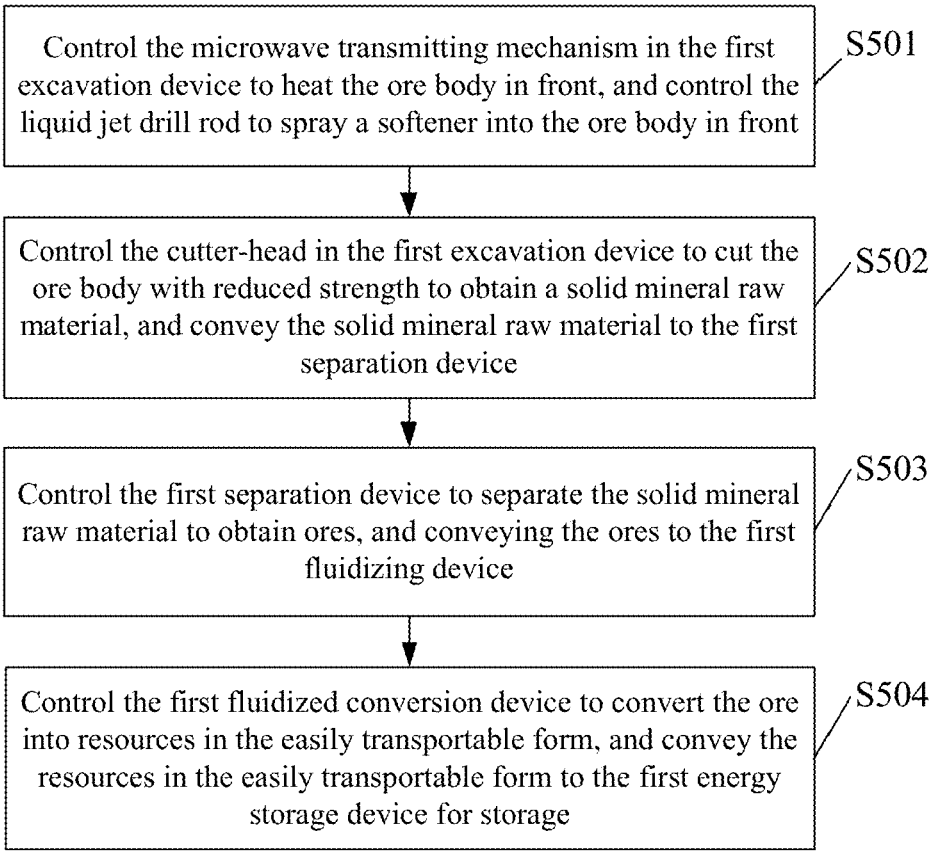
FIG. 5 is a flow chart of a fluidized mining method according to an embodiment of the present application.

Based on the mining machine disclosed in the above embodiments, a fluidized mining method is correspondingly disclosed by the embodiments of the present application, which is applicable to the mining machine disclosed in the above embodiments. As shown in FIG. 5, FIG. 5 is a schematic flow chart of an automated mining method according to an embodiment of the present application. The method includes the following steps:

S501: controlling the microwave transmitting mechanism in the first excavation device to heat the ore body in front, and controlling the liquid jet drill rod to spray a softener into the ore body in front;

S502: controlling the cutter-head in the first excavation device to cut the ore body with reduced strength to obtain the solid mineral raw material, and conveying the solid mineral raw material to the first separation device;

S502: controlling the first separation device to separate the solid mineral raw material to obtain ores, and conveying the ores to the first fluidized conversion device;

S503: controlling the first fluidized conversion device to convert the ore into resources in the easily transportable form, and conveying the resources in the easily transportable form to the first energy storage device for storage.

The principle of the corresponding operations performed by the devices in the fluidized mining method disclosed in the embodiments of the present application can be referred to the same part of the mining machine of the present application, which will not be repeated herein again.

According to the fluidized mining method disclosed in the embodiments of the present application, the first excavation device is controlled to cut the ore body in front of the first excavation device, and the solid mineral raw material obtained by cutting is conveyed to the first separation device; then, the first separation device is controlled to separate the solid mineral raw material to obtain ores, and the ores are conveyed to the first fluidized conversion device; then, the first fluidized conversion device is controlled to convert the ore into resources in the easily transportable form, and the resources in the easily transportable form are conveyed to the first energy storage device for storage. With this method disclosed by the embodiments of the present application, the ore mined by the mining machine can be directly converted, under the ground, into resources in the easily transportable form, without transporting the ore to the surface for conversion, which saves the cost of transporting the ore to the surface, and reduces lots of pollution such as solid waste pollution and air pollution.

In the present application, terms such as "include", "comprise" or any other variants are intended to be non-exclusive. Therefore, a process, method, article or device including multiple elements includes not only the elements but also other elements that are not enumerated, or further includes the elements inherent to the process, method, article or device. With no other limitations, an element restricted by the phrase "include a . . . " does not exclude the existence of other identical elements in the process, method, article or device including the element.

The embodiments in the specification are described in a progressive manner, with the emphasis of each of the embodiments on the difference from other embodiments. For the same or similar parts between the embodiments, reference may be made one to another. Since the system or the system embodiment is similar to the method embodiment, the description for the system or the system embodiment is simple, and reference may be made to the method embodiment for the relevant parts. The above system and the above system embodiment are only illustrative. The units described as separate components may be or may not be separated physically, and the components shown as units may be or may not be physical units, that is, the units may be located at the same position or may be distributed onto multiple network units. A part or all of the modules may be selected based on actual needs to implement the solution according to the embodiment. Those skilled in the art may understand and implement the present disclosure without creative work.

Those skilled in the art may further realize that the units and algorithm steps of the examples described in combination with the embodiments disclosed herein can be implemented by electronic hardware, computer software, or a combination thereof. To clearly describe interchangeability of hardware and software, the composition and steps of each example have been generally described in terms of their functionality in the above description. Whether these functions being implemented by hardware or software depends on the specific application and design constraints of the technical solutions. A person skilled in the art may use different methods to implement the described functions for each particular application, but such implementation should not be considered as going beyond the scope of the present disclosure.

Based on the above description of the disclosed embodiments, those skilled in the art are capable of carrying out or using the present application. Many changes to these embodiments are apparent for those skilled in the art, and general principles defined herein may be implemented in other embodiments without departing from the spirit or scope of the present disclosure. Hence, the present disclosure is not limited to the embodiments disclosed herein, but is to conform to the widest scope in accordance with the principles and novel features disclosed herein.

The invention claimed is:

1. A mining machine applicable to fluidized mining, comprising:

a first excavation device, a first separation device, a first fluidized conversion device and a first energy storage device;

wherein the first excavation device is connected to the first separation device by a detachable flexible component, and a microwave transmitting mechanism, a liquid jet drill rod and a cutter-head are provided on a head of the first excavation device;

the microwave transmitting mechanism is configured to heat an ore body in front of the first excavation device to reduce strength of the ore body;

the liquid jet drill rod is configured to drill into the ore body in front of the first excavation device and spray a softener into the ore body in front of the first excavation device to reduce the strength of the ore body;

the cutter-head is configured to cut the ore body with reduced strength to obtain a solid mineral raw material, and the solid mineral raw material is transported to the first separation device;

the first separation device is connected to the first fluidized conversion device by the detachable flexible component, and is configured to separate ores and waste rocks in the solid mineral raw material and convey the ores after separation to the first fluidized conversion device;

the first fluidized conversion device is connected to the first energy storage device by the detachable flexible component, and is configured to convert the ores into resources in an easily transportable form and convey the resources in the easily transportable form to the first energy storage device for storage; and the resources in the easily transportable form comprise at least one of fluidized resources, electrical energy, and thermal energy, and the fluidized resources comprise at least one of gas resources, liquid resources, and solid-liquid mixed resources.

2. The mining machine applicable to fluidized mining according to claim 1, wherein the first excavation device comprises:

the microwave transmitting mechanism, a plurality of liquid jet drill rods, the cutter-head, a pushing mechanism and a first conveyor belt;

the microwave transmitting mechanism is arranged at a middle of the head of the first excavation device, and the plurality of liquid jet drill rods are uniformly distributed around the head of the first excavation device;

the cutter-head is arranged at the head of the first excavation device;

the pushing mechanism is fixed on a bottom plate of the first excavation device, and is located behind the cutter-head, and is configured to allocate the solid mineral raw material obtained by cutting to the first conveyor belt; and the first conveyor belt is arranged on the bottom plate behind the pushing mechanism, and extends into the first separation device, and is configured to convey the solid mineral raw material on the first conveyor belt to the first separation device.

3. The mining machine applicable to fluidized mining according to claim 2, wherein the first excavation device further comprises a first supporting seat and a supporting mechanism;

the first supporting seat is fixed on the bottom plate of the first excavation device and is configured to support the supporting mechanism; and the supporting mechanism is fixed on the first supporting seat, and is configured to reinforce an excavated roadway.

4. The mining machine applicable to fluidized mining according to claim 3, further comprising a supporting device;

wherein the supporting device comprises a second supporting seat, a grouting reinforcement mechanism and a roadway lining mechanism;

the second supporting seat is fixed on a bottom plate of the supporting device;

the grouting reinforcement mechanism is fixed on the second supporting seat, and is configured to reinforce mine walls on two sides of a roadway; and the roadway lining mechanism is fixed on the bottom plate of the supporting device, and is located behind the second supporting seat, and is configured to line and support the roadway.

5. The mining machine applicable to fluidized mining according to claim 4, wherein the supporting device further comprises a third supporting seat and a gas extraction mechanism;

wherein the third supporting seat is fixed on the bottom plate of the supporting device; and the gas extraction mechanism is fixed on the third supporting seat, and is configured to extract the gas resources in the mine walls on two sides of the roadway.

6. The mining machine applicable to fluidized mining according to claim 2, wherein the first separation device comprises a crusher, a second conveyor belt and an adjusting density separation mechanism;

the crusher is fixed on a bottom plate of the first separation device, and is configured to crush the solid mineral raw material obtained by cutting;

the second conveyor belt is fixed on the bottom plate of the first separation device, and is located behind the crusher, and is configured to convey the crushed solid mineral raw material to the adjusting density separation mechanism; and the adjusting density separation mechanism is fixed on the bottom plate of the first separation device, and is located behind the second conveyor belt, and is configured to separate the crushed solid mineral raw material to obtain ores and waste rocks and convey the ores to the first fluidized conversion device.

7. The mining machine applicable to fluidized mining according to claim 1, wherein the first fluidized conversion device comprises a fluidizing mechanism and a purification mechanism;

the fluidizing mechanism is fixed on a bottom plate of the first fluidized conversion device, and is configured to convert the ores into resources in an easily transportable form and convey the resources in the easily transportable form to the first energy storage device; and the purification mechanism is fixed on the bottom plate of the first fluidized conversion device, and is located behind the fluidizing mechanism, and is configured to purify and convert waste generated by the fluidizing mechanism.

8. The mining machine applicable to fluidized mining according to claim 1, wherein the first energy storage device comprises a first storage mechanism and a second storage mechanism;

the first storage mechanism is fixed on a bottom plate of the first energy storage device, and is configured to store the fluidized resources; and the second storage mechanism is fixed on the bottom plate of the first energy storage device, and is configured to store the electrical energy and thermal energy.

9. The mining machine applicable to fluidized mining according to claim 1, further comprising a second excavation device, a second separation device, a second fluidized conversion device, and a second energy storage device;

wherein the second excavation device is connected to the second separation device by the detachable flexible component, and is configured to cut the ore body in front of the second excavation device to obtain the solid mineral raw material, and the solid mineral raw material is transported to the second separation device;

the second separation device is connected to the second fluidized conversion device by the detachable flexible component, and is configured to separate ores and waste rocks in the solid mineral raw material and convey the ores after separation to the second fluidized conversion device;

the second fluidized conversion device is connected to the second energy storage device by the detachable flexible component, and is configured to convert the ores into resources in an easily transportable form and convey the resources in the easily transportable form to the second energy storage device for storage, wherein the resources in the easily transportable form comprise at least one of fluidized resources, electrical energy, and thermal energy, and the fluidized resources comprise at least one of gas resources, liquid resources, and solid-liquid mixed resources; and the second energy storage device is connected to the first energy storage device by the detachable flexible component, and is configured to store the resources in the easily transportable form converted by the second fluidized conversion device.

10. The mining machine according to claim 9, further comprising a remote console;

the remote console is configured to control working states of the first excavation device, the first separation device, the first fluidized conversion device, and the first energy storage device;

or, the remote console is further configured to control working states of the second excavation device, the second separation device, the second fluidized conversion device, and the second energy storage device.

11. A fluidized mining method applied to a mining machine, wherein the mining machine is the mining machine according to claim 1, and the fluidized mining method comprises:

controlling the microwave transmitting mechanism in the first excavation device to heat the ore body in front of the first excavation device, and controlling the liquid jet drill rod in the first excavation device to spray a softener into the ore body in front of the first excavation device;

controlling the cutter-head in the first excavation device to cut the ore body with reduced strength to obtain the solid mineral raw material, and conveying the solid mineral raw material to the first separation device;

controlling the first separation device to separate the solid mineral raw material to obtain ores, and conveying the ores to the first fluidized conversion device; and controlling the first fluidized conversion device to convert the ores into resources in the easily transportable form, and conveying the resources in the easily transportable form to the first energy storage device for storage, wherein the resources in the easily transportable form comprise at least one of fluidized resources, electrical energy, and thermal energy, and the fluidized resources comprise at least one of gas resources, liquid resources, and solid-liquid mixed resources.

* * * * *